US005711689A

United States Patent [19]

Newman et al.

[11] Patent Number: 5,711,689

[45] Date of Patent: *Jan. 27, 1998

[54] REVERSE WIRE TERMINATION DEVICE

[75] Inventors: Walter Newman, Bayside; Paul Endres, Glen Oaks, both of N.Y.

[73] Assignee: Leviton Manufacturing Co., Inc., Little Neck, N.Y.

[ * ] Notice: The portion of the term of this patent subsequent to Jan. 19, 2014, has been disclaimed.

[21] Appl. No.: 762,756

[22] Filed: Dec. 10, 1996

Related U.S. Application Data

[63] Continuation of Ser. No. 443,745, May 18, 1995, abandoned.

[51] Int. Cl.[6] ..... H01R 4/30

[52] U.S. Cl. ..... 439/801; 439/881

[58] Field of Search ..... 439/877, 881, 439/882, 801

*Primary Examiner*—Neil Abrams
*Assistant Examiner*—Daniel Wittels
*Attorney, Agent, or Firm*—Paul J. Sutton

[57] ABSTRACT

A terminal for terminating an insulated conductor comprised of a crimp barrel having a strain relief section for crimping to the conductor insulation and a conductor gripping section for crimping to the bared end of the central conductor and a lug for connecting the terminated conductor to an electrical device. The lug extends away from the conductor gripping section towards the strain relief section and ends in an attachment section at right angles to the longitudinal axis of the conductor. The lug arrangement permits connection to terminals without bending the lug or conductor, and if made of spring material can be used to control the portion of electrical contacts.

7 Claims, 3 Drawing Sheets

REVERSE WIRE TERMINATION DEVICE

This application is a continuation of U.S. patent application Ser. No. 08/443,745, filed May 18, 1995, now abandoned.

BACKGROUND OF THE INVENTION

1. Field of the Invention

The invention pertains to the termination of insulated conductors, and more particularly to a wire termination device to be used to join insulated electrical conductors to electrical devices.

2. Description of the Prior Art

In the prior art insulated electrical conductors are terminated with termination devices having crimp barrels and lugs that extend along the longitudinal axis of the conductor they terminate.

The crimp barrels have strain relief sections for gripping the conductor insulation, when crimped, to provide strain relief to the termination conductor joint to prevent damage to such joint by forces applied to the insulated conductor. The crimp barrel further includes a gripping section for crimping to the central conductor. The gripping section will be crimped directly to the bared end of the insulated conductor or if provided with insulation displacing or piercing teeth, can be crimped to the insulated conductor without baring the end of the insulated conductor.

The prior art termination devices are intended to be crimped to the end of an insulated conductor and extend along the longitudinal axis of the conductor and be an extension of such conductor. These devices were intended to be used on terminal blocks and other devices where the conductor and terminator remained along the same longitudinal axis. However, when it was necessary to couple the terminated conductor to a device at right angles to such longitudinal axis, as with a lampholder or the like, it was necessary to bend the conductor to align the termination device with the utilization device, this often resulted in damage to the conductor, pull-out of the conductor from the termination device or breaking of the lug of the termination device. These effects resulted in a high resistance joint which could burn up or no joint at all.

SUMMARY OF THE INVENTION

The instant invention overcomes the difficulties noted above with respect to known prior art device. The lug portion of the termination device extends at right angles to the longitudinal axis of the insulated conductor and at a point away from the end of the conductor. In this manner the insulated conductor can be terminated to an electrical device perpendicular to the longitudinal axis of the conductor without the risk of damage to the conductor, the termination or the termination device.

Additional strain relief can be provided for the conductor and the conductor/termination joint by providing a pocket in the electrical device which can retain the crimp barrel therein and absorb some of the forces applied to the conductor which would otherwise break or injure the conductor termination. The termination device can be fabricated from copper or a copper alloy or if spring characteristics are desired, from beryllium or beryllium copper or beryllium steel. The termination device having spring characteristics can be used to position electrical contacts in a device such as a lampholder. It is an object of this invention to provide a novel conductor termination device.

It is an object of this invention to provide a novel conductor termination device at a terminal point perpendicular to the longitudinal axis of the conductor.

It is another object of this invention to provide a novel conductor termination device where the lug portion extends away from the conductor end and perpendicular to the longitudinal axis of the conductor.

It is still another object of this invention to permit a conductor to be terminated to a terminal point perpendicular to the longitudinal axis of the conductor without damage to the conductor, the termination device or the joint between the conductor and the termination device.

Other objects and features of the invention will be pointed out in the following description and claims and illustrated in the accompanying drawings, which discloses, by way of example, the principles of the invention, and the best mode which is presently contemplated for carrying them out.

BRIEF DESCRIPTION OF THE DRAWINGS

In the drawings in which similar elements are given similar reference characters.

DESCRIPTION OF THE PREFERRED EMBODIMENTS

Figure 3:
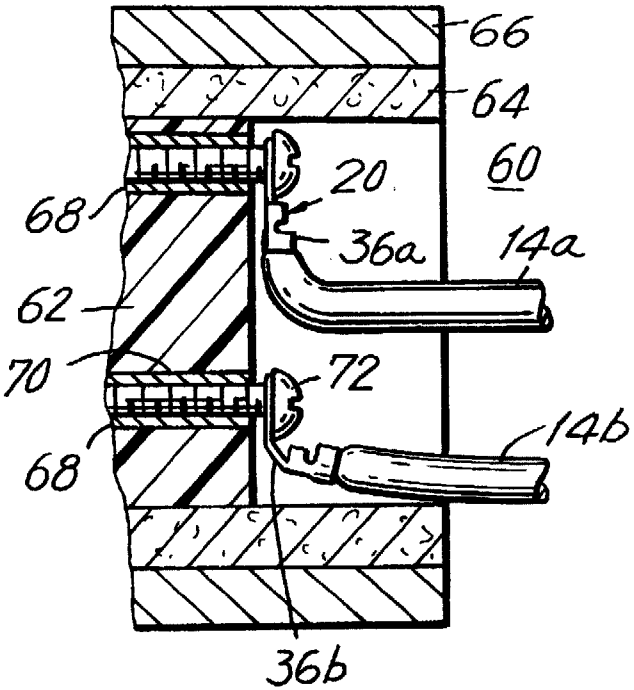
FIG. 3 PRIOR ART
FIG. 3 is a fragmentary side elevational view, partly in section, of the conductor and termination device of FIG. 1 installed to an electrical device at a position perpendicular to the longitudinal axis of the conductor and termination device.
Figure 1:
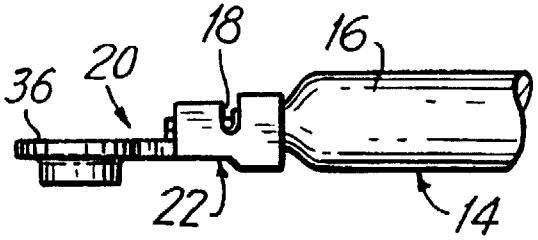
FIG. 1 PRIOR ART
FIG. 1 is a side elevational view of an insulated electrical conductor with a termination device according to the prior art installed thereon.
Figure 2:
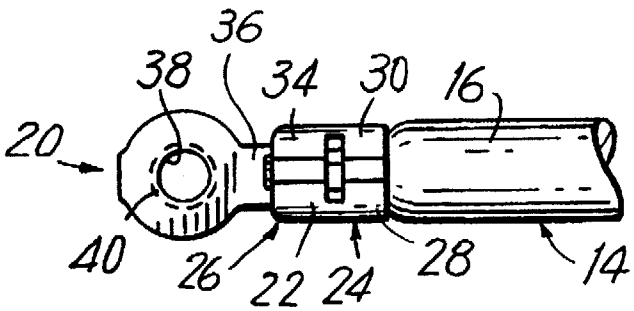
FIG. 2 PRIOR ART
FIG. 2 is a top plan view of the conductor and termination device of FIG. 1.

Turning now to FIGS. 1, 2 and 3 there is shown a termination device 20 constructed according to the prior art applied to insulated conductor 14 having an insulation jacket 16 and a central electrical conductor 18. The central conductor 18 may be made of a number of strands or a single elongate conductor while the insulation jacket may be made of rubber, vinyl, polypropylene, teflon or similar insulating materials.

Termination device 20 has a crimp barrel 22 made up of a strain relief section 24 and a conducotr grip section 26. Strain relief section 24 has two arms 28 and 30 which are crimped to the insulation so that forces applied to the conductor 14 are not transmitted to the joint with central electrical conductor 18. Crimp barrel 22 also has a conductor grip section 26 having two arms 32 and 34 which are crimped to the central conductor 18. Conductor grip section 26 is crimped directly to the bared end of conductor 14 if a section of the insulation 16 is removed to expose central conductor 18. Alternatively, if the interior surface of conductor grip section 26 is provided with insulation displacing or piercing teeth (not shown) grip section 26 can be crimped to conductor 14 without removing any of the insulation 16.

Figure 6:
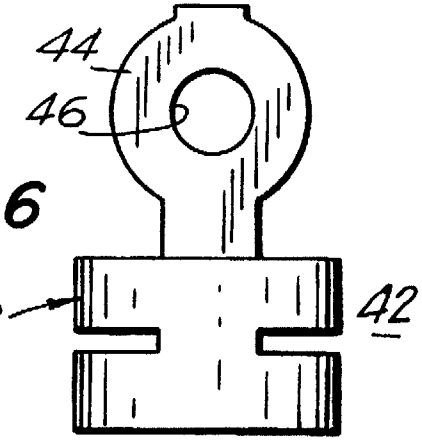
FIG. 6 is a top plan view of the termination device similar to FIG. 4 before the lug is bent out of the plane of the crimping barrel.
Figure 10:
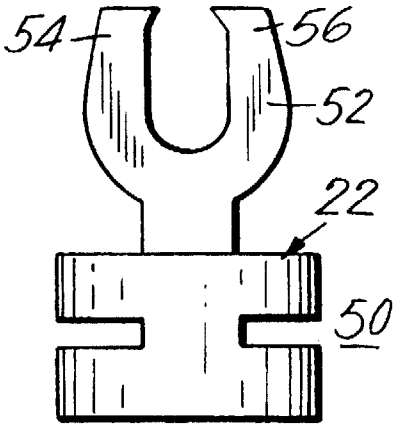
FIG. 10 is similar to FIG. 6 but shows a fork-type lug instead of the ring-type lug of FIG. 6.

Termination device 20 has a lug 36 extending beyond crimp barrel 22 in which is placed an aperture 38 threaded as at 40 to receive a threaded screw therein as will be described below with respect to FIG. 9. A termination device 42, as shown in FIG. 6, is similar to termination device 20, except that lug 44 has an unthreaded aperture 46 therein. Both of the termination devices 20 and 42 are termed in the art ring-type terminations. FIG. 10 shows a termination device 50 which has a fork shaped lug 52, with two tines 54,56 intended to be placed along the threaded shank of a terminal screw and under the enlarged head of such screw (not shown). The fork-type termination device 50 does not require the terminal screw to be removed but merely loosened enough to permit the tines 54,56 to be slipped under the enlarged head. The ring-type termination devices 20 and 42 require removal of the terminal screw.

FIG. 3 shows two conductors 14, with prior art termination device 20 installed at their ends, terminated in an electrical device 60, which may be, for example, a lampholder. Lampholder 60 has an insulative base 62 surrounded by an insulating fiber sleeve 64 which in turn is surrounded by a metal jacket 66. Within base 62 are two electrical contacts 68 which at their remote ends (not shown) are connected to the two ends of the filament of the lamp inserted into the lampholder 60 and not shown. The visible ends of the contacts 68 are internally threaded as at 70 to receive a terminal screw 72.

To accommodate the conductors 14*a* and 14*b* either the conductor 14*a* must be gently curved to align aperture 38 of lug 36 with threaded apertures 76 or the lug 36*a* must be bent as in FIG. 3. The forming of conductors 14*a* in the gentle curve limits access to the interior of electrical device 60. Thus, lug 36*b* of conductor 14*b* is bent. The bending of lug 36*b*, whether intentional or unintentional as a result of work done to lampholder 60, greatly weakens the lug 36*b* and could lead to its premature failure.

Figure 4:
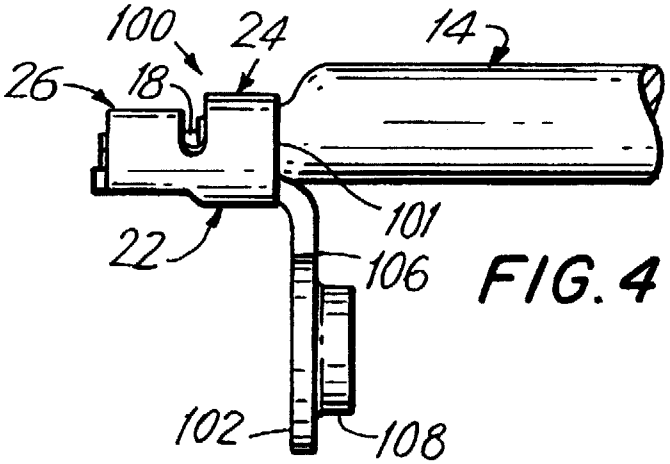
FIG. 4 is a side elevational view of a reverse wire termination device constructed in accordance with the concepts of the invention.
Figure 5:
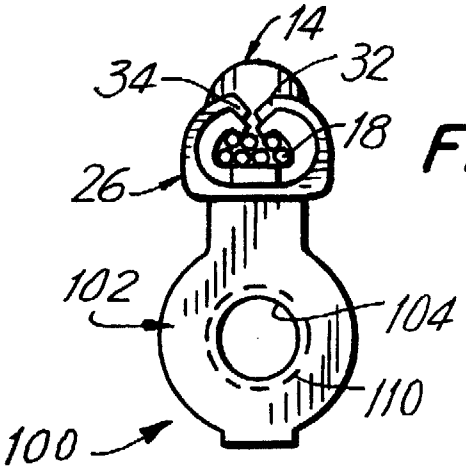
FIG. 5 is a front elevational view of the termination device of FIG. 4.

Turning now to FIGS. 4, 5 and 6 there is shown a termination device 100 constructed in accordance with the concept of the invention. Termination device 100 has a crimp barrel 22 made up of strain relief section 24 and conductor grip section 26 which function in the same manner as they do in termination device 20. The difference between device 20 and device 100 is the arrangement of the lug 102. Instead of projecting beyond the end of the conductor grip section 26 and acting as an extension of the conductor 14, the lug 102 extends from back end 101 of the crimp barrel 22 away from the free end of the conductor 14. Further, lug 102 is bent downwardly, away from the longitudinal axis of conductor 14 in FIG. 4 and perpendicular to such longitudinal axis.

An aperture 104 (FIG. 5) extends through lug 102 and is surrounded on side 106 by a boss 108. The aperture 104 and boss 108 are internally threaded as at 110. As with the termination device 42, a lug 44 can be employed which omits boss 108 and the internal thread 110 and merely has an aperture 46 therethrough. Also, the lug 52 (FIG. 6) of termination device 50 can be a fork terminal having tines 54 and 56.

Figure 7:
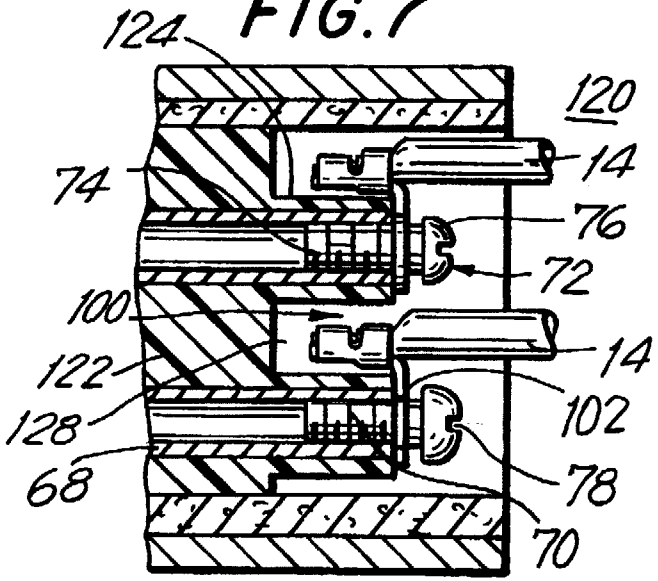
FIG. 7 is a fragmentary side elevational view, partly in section, of the termination device of FIG. 4 installed to an electrical device at a position perpendicular to the longitudinal axis of the conductor.
Figure 8:
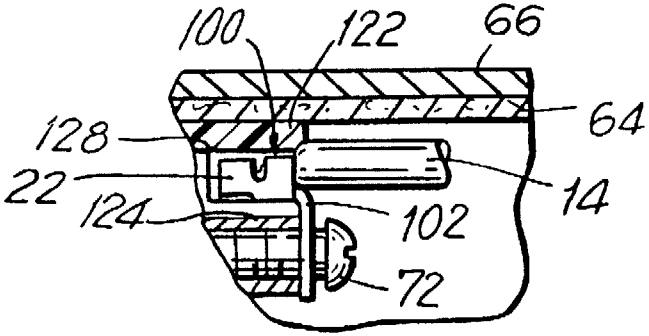
FIG. 8 is a fragmentary side elevational view, partly in section, of a termination device according to the invention installed in a housing that provides a pocket to receive only the crimping barrel of the termination device.

With this configuration it is possible to connect the conductors 14, terminated in termination devices 100, directly to the terminals of an electrical device without having to perform the conductors 14 or bending the lug 102. Electrical device 120 has an insulative base 122 surrounded by an insulating fiber sleeve 64 (FIG. 8) which in turn is surrounded by a metal jacket 66. Base 122 (FIG. 7) is formed with two hubs 124, each of which contains an electrical contact 68 connected at one end to one side of a lamp filament (not shown). The visible ends of contacts 68 are internally threaded as at 70. Terminal screws 72 have externally threaded shanks 74 which mate with internally threaded portion 70 of contact 68 and an enlarged head portion 78 with a screw driver slot 80.

To fasten lug 102 (FIG. 8) to link 124, it is necessary to unscrew terminal screw 72 and pass shank 74 through aperture 104 in lug 102 and then retread shank 74 into threaded portion 70 of contact 68. This is true whether lug 102 of termination device 100 with threaded boss 108 or lug 44 of termination device 42 without such a threaded boss is used. The fork-type lug 52 of termination device 50 does not require removal of terminal screw 72. It only requires that terminal screw 72 be backed off sufficiently so that lug 52 can be placed under enlarged head portion 76 of screw 72. The tines 54,56 take positions to either side of shank 74 of screw 72 and under head 76. The screw 72 can then be tightened to fix the position of lug 52.

It is obvious that conductors 14 terminated with termination devices such as 100 can be housed in an electrical device having a smaller diameter and decreased size as compared to prior art device as shown in FIG. 3, and that such termination can be accomplished without shaping or distorting the conductors 14 before or after installation and without bending the termination device either intentionally to position the conductor 14 in the electrical device 120 or unintentionally as may occur when any excess conductor 14 is pushed into the electrical device 60 to put a cover or other device over the exposed portion of the electrical device 60.

To provide additional strain relief for the joint of conductor 14 to electrical device 120, the base 126 is made of two mating halves (not shown) which are assembled to form the base 126. In each of the halves a pocket 128 is formed. When the mating halves are assembled, the conductor gripping portion 22 of termination device 100 is totally enclosed by the walls that make up the pockets 128. Any forces applied to the conductor 14 are in effect applied to base 126 first.

As stated above, the termination device, for example, 20 of FIG. 3 can be made of copper or a copper alloy. Termination devices such as 100, may also be made from spring stock such as beryllium copper or stainless steel.

Figure 9:
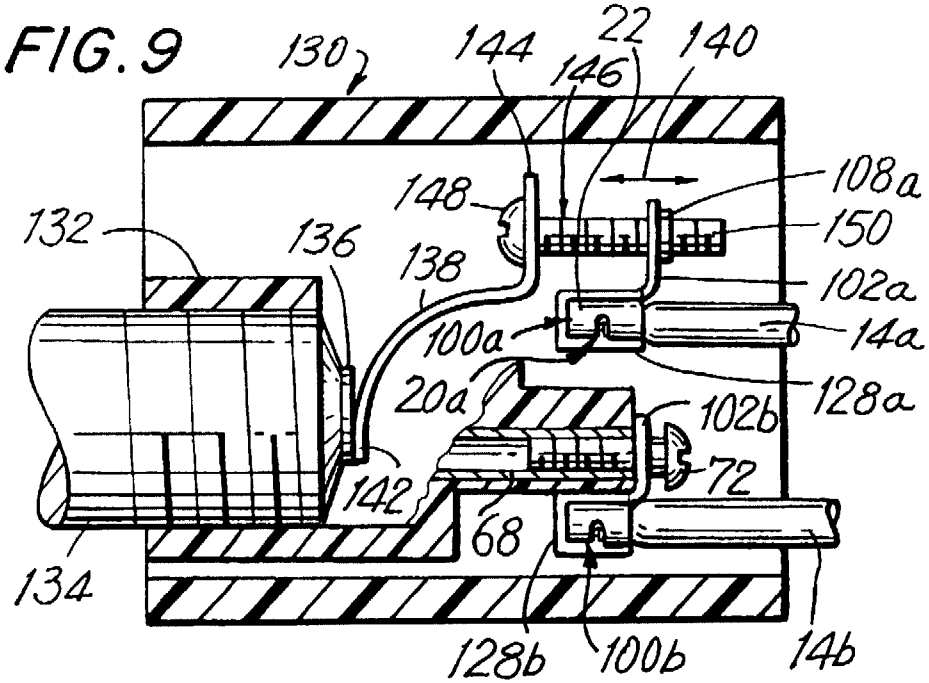
FIG. 9 is a side elevational view, partly in section, of a lampholder with a termination device according to the invention installed in a pocket of the lampholder body to receive only the crimping barrel of the termination device and acts upon a spring contact to urge it into contact with a contact button of an inserted lamp.

One use of a termination device 100 made of beryllium copper is shown in FIG. 9 where it is desired to maintain electrical continuity between a contact arm and the base button of a lamp. Electrical device 130 (only one half of which is shown) is made entirely of plastic except for metal lamp socket 132 into which lamp 134 is screwed. One side of the filament (now shown) of lamp 134 is connect to a source of power through conductor 14*b* via contact 68 connected to socket 132. Terminal screw 72 fixes lug 102*b* of termination device 100*b* to contact 68 and pocket 128*b* provides strain relief as described above with respect to FIG. 8.

The other end of the filament (not shown) of lamp 134 is connected via button contact 136 and contact arm 138 to electrical conductor 14*a*. Conductor 14*a* is terminated in termination device 100*a* which is position in pocket 128*a*. In addition to providing strain relief for the joint between conductor 14*a* and the crimp barrel 20, pocket 128*a* also holds termination device 100*a* in the position shown and prevents its movement. The space about lug 102*a* allows lug 102*a* to pivot about its joint with crimp barrel 20 in the two opposite directions shown by arrow 140.

Contact arm 138 engages, at a first end 142, the base button 136 of lamp 134 and at a second end 144, the enlarged head 148 of screw 146. A threaded aperture (not shown) in second end 144 permits the threaded stud 150 of screw 146 to pass through the threaded aperture of contact arm 138 and engage the threaded aperture 104 and boss 108*a*. By rotating head 148 of screw 146 the spacing between lug 102*a* and contact arm 138 second end 144 can be varied to insure that first end 142 makes intimate contact with base button 136. Any change of position of contact arm 138 will be transmitted to lug 102*a* via screw 146, causing lug 102*a* to deflect from its shown position. As lug 102*a* returns to the position shown due to its resiliency it also corrects the position of contact arm 138 to again established intimate contact with base button 136. As the parts age or loosen or change their resiliency, the screw 144 can be used to return the desired balance between lug 102*a* and contact arm 138.

While there have been shown and described and point out the fundamental novel features of the invention as applied to the preferred embodiments, it will be understood that various omissions and substitutions and changes of the form and details of the devices illustrated and in their operation may be made by those skilled in the art, without departing from the spirit of the invention. The embodiments of the invention in which an exclusive property or privilege is claimed are defined in the following claims.

What is claimed is:

1. A conductor terminating system comprising:

a) housing means fabricated from insulating material having at least two hubs therein, each of said at least two hubs having a central bore therethrough and at least two pockets, one pocket adjacent each of said at least two hubs;

b) at least two electrical contacts, one for each of said at least two hubs positioned in said central bores of said at least two hubs, each of said at least two electrical contacts having an internally threaded portion;

c) at least two terminal screws, one for each of said at least two hubs, each engaging a threaded portion of its associated one of said two electrical contacts;

d) at least two insulated electrical conductors, each having a central conducting means surrounding by insulation;

e) at least two conductor termination devices, one for each of said at least two insulated electrical conductors;

f) each of said at least two conductor termination devices having a crimp barrel means extending along a longitudinal axis of said insulated electrical conductor having a conductor gripping portion adjacent a first end of said crimp barrel means adapted to be crimped to and make electrical contact with said central conducting means adjacent said free end of said elongate insulated conductor and an insulation gripping portion adjacent a second end of said crimp barrel means adapted to be crimped to said insulation to provide strain relief for said elongate insulated conductor;

g) at least two lug means, one for each of said two conductor termination devices, formed integrally with said crimp barrel means and extending away from said second end of said crimp barrel means to a free end in a plane perpendicular to said longitudinal axis of said crimp barrel means; and h) said at least two lug means each having an aperture therein to receive one of said at least two terminal screws to permit said lug means to be mounted to an associate one of said at least two hubs by engaging said terminal screw with the internally threaded portion of said associated contact in said hub with a portion of said associated conductor termination device in said associated pocket whereby said insulated electrical conductor extends in a plane parallel with a longitudinal axis of said associated hub.

2. A conductor terminating system, as defined in claim 1, wherein the insulation of each of said at least two insulated electrical conductors at a free first end which will be crimped to said conductor gripping portion of said crimp barrel means is removed.

3. A conductor terminating system, as defined in claim 1, wherein each of said at least two conductor gripping portion has an outside surface and an inside surface, said inside surface of said conductor gripping portion having a plurality of insulation piercing teeth to pierce the insulation of said elongate insulated conductor and make electrical contact with said central conducting means when said conductor gripping portion is crimped to said elongate insulated conductor.

4. A conductor terminating system, as defined in claim 1, wherein each of said at least two lug means further comprises:

a) a boss about said aperture;

b) a passage through said boss in communication with said aperture; and c) said aperture and said passage being threaded.

5. A conductor terminating system, as defined in claim 1, wherein said conductor termination device is made of copper.

6. A conductor terminating system, as defined in claim 1, wherein said conductor termination device is made of a metal having spring characteristics.

7. A conductor terminating system, as defined in claim 1, wherein said at least two lug means each have a slot extending from said aperture to said free end to form a fork-like configuration.

* * * * *

UNITED STATES PATENT AND TRADEMARK OFFICE

CERTIFICATE OF CORRECTION

PATENT NO. : 5,711,689

DATED : January 27, 1998

INVENTOR(S) : Walter Newman, et al.

It is certified that error appears in the above-indentified patent and that said Letters Patent is hereby corrected as shown below:

On the title page, the data in item [63] Related U.S. Application Data, should be deleted and substitute therefor:

--Continuation of Ser. No. 573,470, Dec. 15, 1995, Pat. No. 5,624,287, which is a continuation of Ser. No. 443,745, May 18, 1995, abandoned, which is a continuation of Ser. No. 184,424, Jan. 19, 1994, Pat. No. 5,533,916.--.

Column 1, delete lines 3-5, and substitute therefor:

--This application is a continuation of application Ser. No. 08/573,470, filed Dec. 15, 1995, which is now U.S. Pat. No. 5,624,287 issued April 29, 1997, which is a continuation of U.S. patent application Ser. No. 08/443,745, filed May 18, 1995, now abandoned, which in turn is a continuation of application Ser. No. 08/184,424, filed Jan. 19, 1994, now U.S. Pat. No. 5,533,916 issued Jul. 9, 1996.--.

Signed and Sealed this

FourthDay of August, 1998

Bruce Lehman

*Attest:*

BRUCE LEHMAN

*Attesting Officer*

*Commissioner of Patents and Trademarks*